US005332230A

United States Patent [19]

Benedict

[11] Patent Number: 5,332,230

[45] Date of Patent: Jul. 26, 1994

[54] BAG TOSS GAME APPARATUS

[76] Inventor: Michael L. Benedict, 1585 Homer Rd. #107, Winona, Minn. 55987

[21] Appl. No.: 130,689

[22] Filed: Oct. 4, 1993

[51] Int. Cl.[5] ..... A63B 63/00; A63B 67/00

[52] U.S. Cl. ..... 273/346; 273/345; 273/400; 273/402; 273/407; 273/409; 273/415; 273/DIG. 30

[58] Field of Search ..... 273/346, 345, 347, 348, 273/398, 400, 401, 402, 407, 409, 415, 424, 425, DIG. 30

[56] References Cited

U.S. PATENT DOCUMENTS

| | | | |
|---|---|---|---|
| 922,717 | 5/1909 | Parker | 273/401 |
| 4,186,925 | 2/1980 | Goldfarb et al. | 273/415 X |
| 4,938,485 | 7/1990 | Hockridge et al. | 273/401 |
| 4,986,549 | 1/1991 | Kuhtic et al. | 273/402 |
| 5,067,727 | 11/1991 | Crompton | 273/346 X |

*Primary Examiner*—William H. Grieb

*Attorney, Agent, or Firm*—E. Michael Combs

[57] ABSTRACT

A foldable target structure includes first, second, and third game plates, each having distinctive geometrical configurations arranged for opening and securement in a triangular configuration, wherein a central opening includes a central opening periphery fastener structure about the central opening through each game plate, with further openings and further hook and loop fastener peripheries, as well as hook and loop fastener patches mounted upon each game plate of various geometrical configurations between respective game plates. The bag structure employed includes bag first and second sides, having first and second side hook and loop fastener surfaces arranged for securement to the hook and loop fastener surfaces of the game plates, wherein various point totals are awarded for directing the bag member through the opening, as well as the bag's adherence to hook and loop fastener surfaces of respective game plate structure.

3 Claims, 4 Drawing Sheets

BAG TOSS GAME APPARATUS

BACKGROUND OF THE INVENTION

1. Field of the Invention

The field of invention relates to bean bag and toss game structure, and more particularly pertains to a new and improved bag toss game apparatus wherein the same is directed to provide for game total awards in the projecting of a flexible bag member through one of a plurality of potential targets in a game board structure.

2. Description of the Prior Art

Various toss game structure is available in the prior art such as exemplified in the U.S. Pat. Nos. 4,938,485; 5,067,727; 4,986,549; and 4,186,925.

The instant invention attempts to overcome deficiencies of the prior art by providing for a bag toss game structure providing for ease of use as well as variety of targets employed and in this respect, the present invention substantially fulfills this need.

SUMMARY OF THE INVENTION

In view of the foregoing disadvantages inherent in the known types of bag toss game apparatus now present in the prior art, the present invention provides a bag toss game apparatus wherein the same is arranged to provide various selective targets for use in a bag toss game organization. As such, the general purpose of the present invention, which will be described subsequently in greater detail, is to provide a new and improved bag toss game apparatus which has all the advantages of the prior art bag toss game apparatus and none of the disadvantages.

To attain this, the present invention provides a foldable target structure including first, second, and third game plates, each distinctive geometrical configurations arranged for opening and securement in a triangular configuration, wherein a central opening includes a central opening periphery fastener structure about the central opening through each game plate, with further openings and further hook and loop fastener peripheries, as well as hook and loop fastener patches mounted upon each game plate of various geometrical configurations between respective game plates. The bag structure employed includes bag first and second sides, having first and second side hook and loop fastener surfaces arranged for securement to the hook and loop fastener surfaces of the game plates, wherein various point totals are awarded for directing the bag member through the opening, as well as the bag's adherence to hook and loop fastener surfaces of respective game plate structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag toss game apparatus which has all the advantages of the prior art bag toss game apparatus and none of the disadvantages.

It is another object of the present invention to provide a new and improved bag toss game apparatus which may be easily and efficiently manufactured and marketed.

It is a further object of the present invention to provide a new and improved bag toss game apparatus which is of a durable and reliable construction.

An even further object of the present invention is to provide a new and improved bag toss game apparatus which is susceptible of a low cost of manufacture with regard to both materials and labor, and which accordingly is then susceptible of low prices of sale to the consuming public, thereby making such bag toss game apparatus economically available to the buying public.

Still yet another object of the present invention is to provide a new and improved bag toss game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
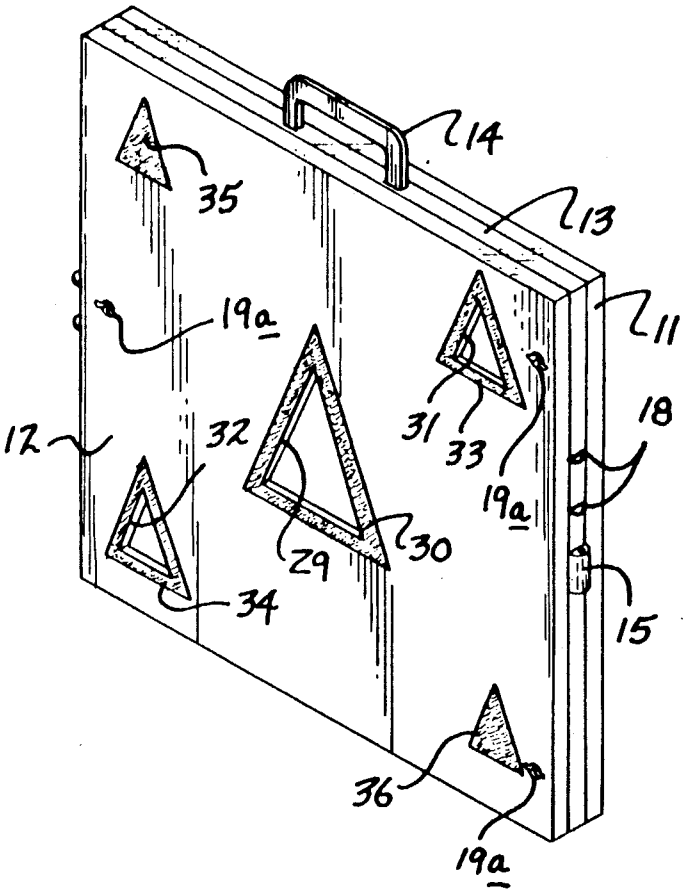
FIG. 2 is an isometric rear view of the target game structure in a folded configuration.
Figure 1:
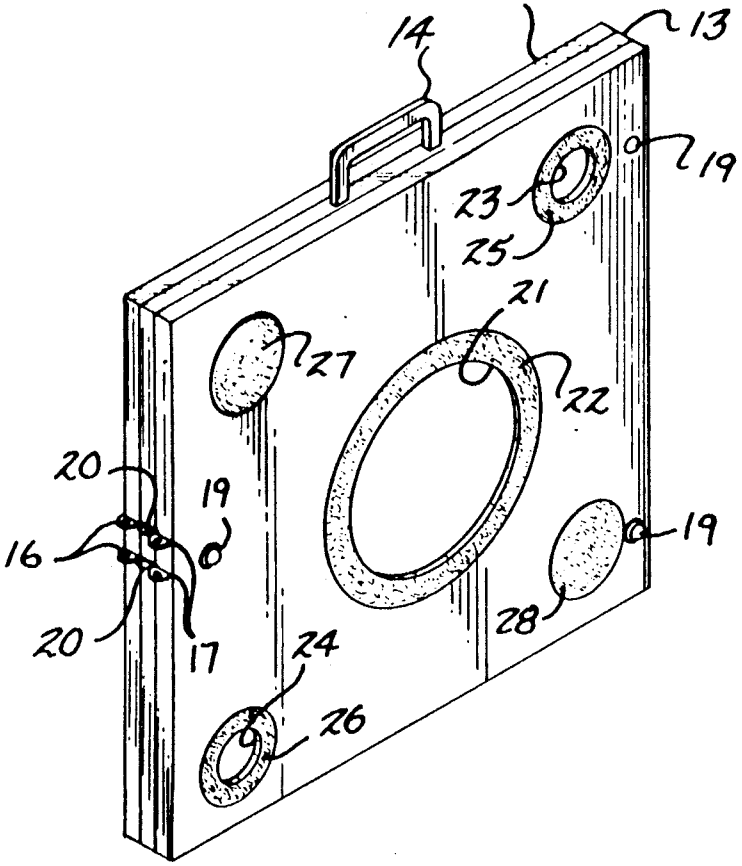
FIG. 1 is an isometric illustration of the target structure of the invention in a folded configuration.
Figure 3:
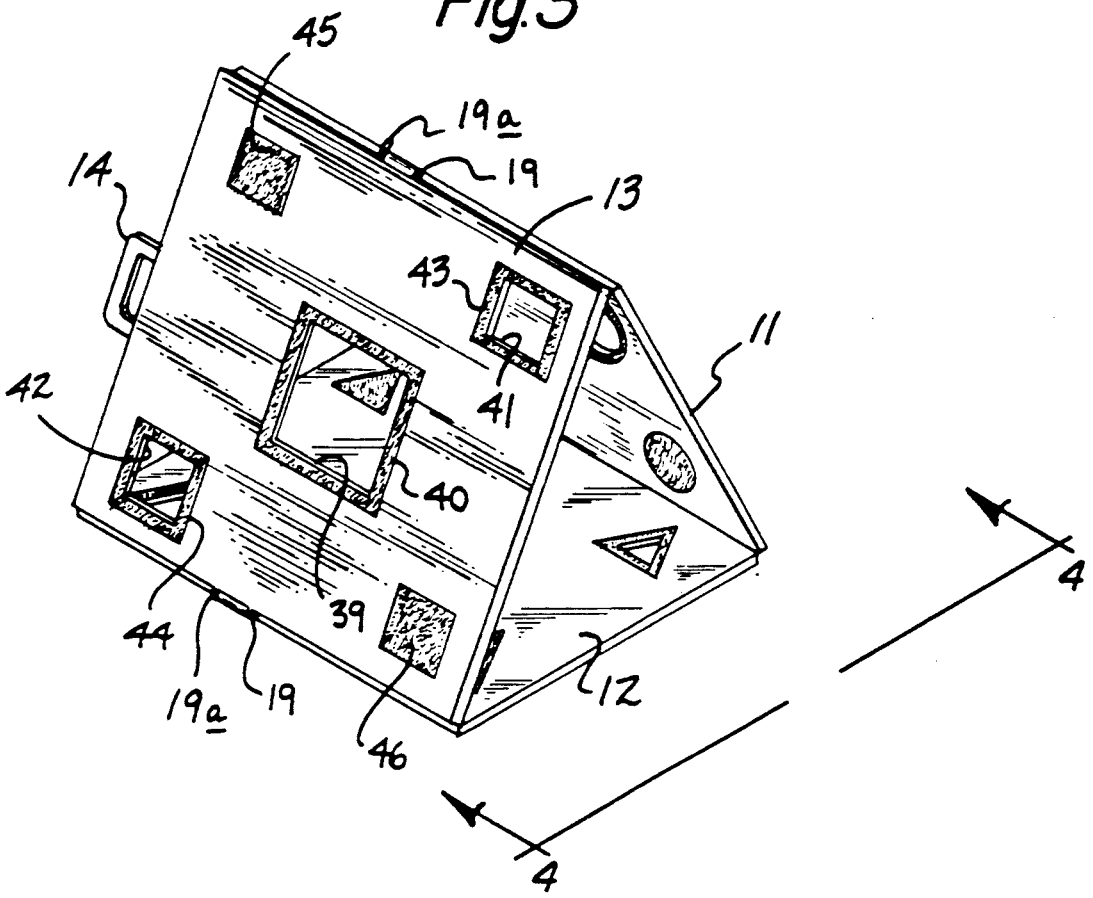
FIG. 3 is an isometric illustration of the target game structure in an opened configuration.
Figure 4:
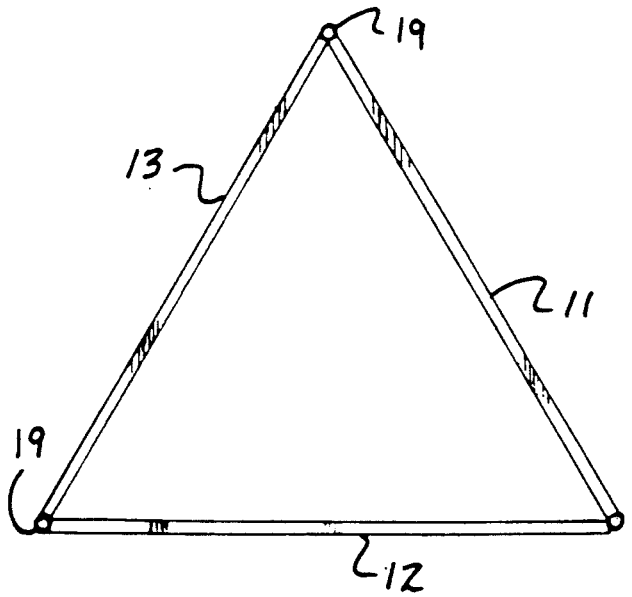
FIG. 4 is an orthographic view, taken along the lines 4—4 of FIG. 3 in the direction indicated by the arrows.
Figure 5:
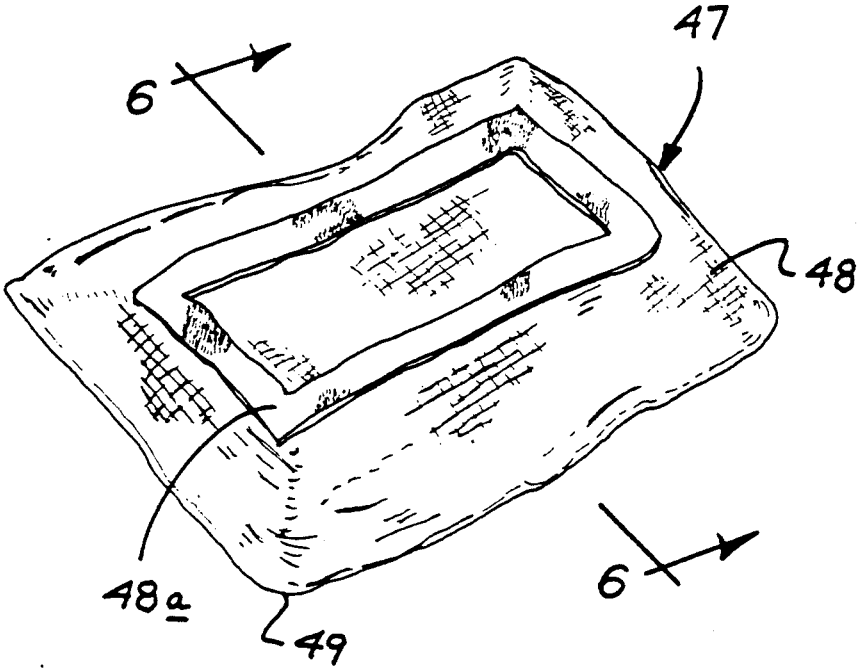
FIG. 5 is an isometric illustration of a bag member employed by the invention.
Figure 6:
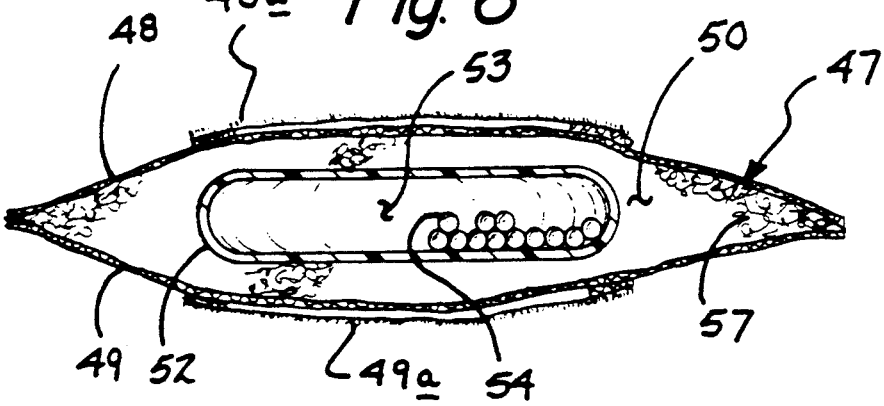
FIG. 6 is an orthographic view, taken along the lines 6—6 of FIG. 5 in the direction indicated by the arrows.
Figure 7:
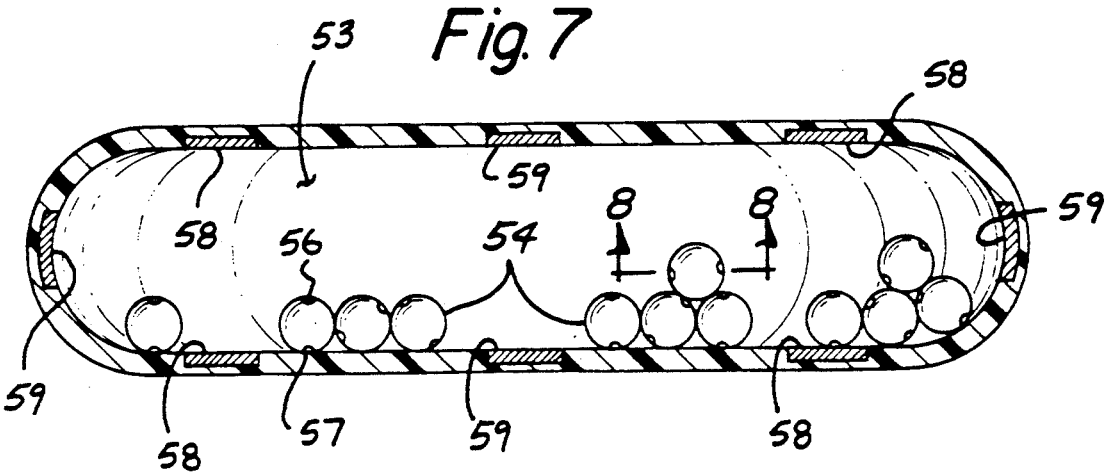
FIG. 7 is an enlarged orthographic cross-sectional illustration of the central housing chamber of the invention.
Figure 8:
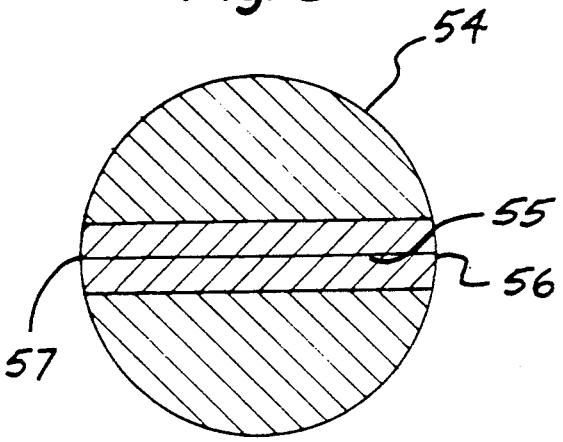
FIG. 8 is an orthographic view, taken along the lines 8—8 of FIG. 7 in the direction indicated by the arrows.

With reference now to the drawings, and in particular to FIGS. 1 to 8 thereof, a new and improved bag toss game apparatus embodying the principles and concepts of the present invention and generally designated by the reference numerals 11–59 will be described.

More specifically, the bag toss game apparatus of the instant invention essentially comprises respective first, second, and third game plates 11, 12, and 13. The game plates are arranged for a folded contiguous side-by-side relationship, as indicated in the FIGS. 1 and 2, for ease of transport, with a handle 14 mounted to the second game plate 12. A first hinge 15 is arranged to pivotally mount the first and second game plates 11 and 12, while first hinge plates 16 and second hinge plates 17 are mounted to the first and second game plates 11 and 12 on opposed ends of the game plates relative to the first hinge 15. Third hinge plates 18 are mounted to the third game plate in adjacency to the first hinge, with fourth hinge plates 20 mounted to the second game plate in adjacency to the first and second hinge plates 16 and 17. The first hinge plates on the first end of the game plate 12 are arranged for securement to the fourth hinge plates 20, with the third hinge plates 18 mounted to a second end of the third plate 13 arranged for mounting to the second hinge plates 17 mounted to a first end of the first plate 11. Hinge pins 19 having pin fasteners 19*a* are arranged for projection through the game plates in an orthogonal relationship to secure the game plates together, wherein such hinge plates are removed for use as pivot pins through the interconnection of the hinge plates together, such as one of the hinge pins 19 arranged for sliding direction through the first and fourth hinge plates 16 and 20. When erected in a triangular configuration, as indicated in the FIGS. 3 and 4, it is noted that the first, second, and third game plates 11, 12, and 13 have respective variously configured openings, such as a central circular opening 21 through the first game plate, having a central circular opening hook and loop periphery 22. Second and third circular openings 23 and 24 have respective second and third circular opening hook and loop fastener peripheries 25 and 26, and first and second circular hook and loop fastener patches 27 and 28 are also mounted onto the first game plate. Similarly, the second game plate includes a central triangular opening 29 having a central triangular opening hook and loop periphery 30, with first and second triangular openings 31 and 32 spaced from the central triangular opening 29, having first and second triangular opening hook and loop fastener peripheries 33 and 34. First and second hook and loop fastener patches 35 and 36 are also mounted onto the second game plate 12. The third game plate 13 includes a central rectangular opening 39 having a central rectangular opening hook and loop fastener periphery 40, with first and second rectangular openings 41 and 42 having respective first and second rectangular opening hook and loop fastener peripheries 43 and 44. First and second rectangular hook and loop fastener patches 45 and 46 are also mounted onto the third game plate. To this end, a plurality of flexible bag members are provided, wherein one such bag member is indicated for use in FIG. 5, having flexible bag member first and second side walls 48 and 49, having first and second side wall hook and loop fastener patches 48*a* and 49*a* respectively. To this end, various point totals are awarded in play of the game exemplified by three points awarded for directing the bag member 47 through one of the aforenoted openings, with two points awarded for adhering a first and second bag side wall 48 or 49 to a hook and loop fastener patch periphery or to one of the patches, such as the rectangular patches 45 and 46. One point is awarded to this end, where it is noted two points may be awarded for hitting a peripheral border. When a predetermined point total is decided upon such as twenty-one for example, a winner is declared.

The bag member 47 is arranged for enhanced enjoyment through the use of a central housing chamber 53 having spheres 54 therewithin permitting the unpredictable path when throwing a bag member towards an associated target, as the spheres are free to rotate within the central housing chamber 53 providing for an eccentrically weighted bag member to be thrown. To enhance such agitation of the bag during a throwing procedure, the FIGS. 7 and 8 indicate that the spheres may be formed each having a magnetic rod 55 directed diametrically through an individual sphere, with the magnetic rod having first and second poles 56 and 57 of respective first and second polarities. First and second magnetic plates 58 and 59 are mounted within the central housing chamber 53 in a facing relationship relative to the spheres 54, such that the first magnetic plates having first and second plate polarities 58 and 59 respectively of opposed polarity are provided and mounted in an alternating relationship relative to one another within the central housing chamber fixedly mounted within the central housing chamber in facing relationship relative to the spheres to provide for agitation and relative attraction and repulsion of the spheres dependent upon which of the magnetic rod poles are directed towards an individual magnetic plate during a throwing procedure.

It should be noted that the central bag housing 52 of rigid construction provided with a central housing chamber 53 is positioned medially of a flexible cavity fill member 57 mounted within the bag cavity 50 to provide for positioning of the housing 52.

To this end, the construction and manner of use of the organization should be clear from the disclosure and accordingly, no further discussion relative to the manner of usage and operation of the invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A bag toss game apparatus, comprising, at least one flexible bag member and target means arranged for receiving said bag member, said target means includes a first game plate, a second game plate, and a third game plate arranged for securement together from a first position, with the first game plate, the second game plate, and the third game plate in a parallel relationship relative to one another to a second position, with the first game plate, the second game plate, and the third game plate arranged in a triangular cross-sectional configuration, the first game plate having first game plate targets, the second game plate having second game plate targets, and the third game plate having third game plate targets, and a first hinge securing the first and second game plates together, and first hinge plates secured to the first game plate, second hinge plate secured to the second game plate, and third hinge plates and fourth hinge plates secured to the third game plate, wherein the third hinge plates and the fourth hinge plates are mounted on opposed ends of the third game plate, and the fourth hinge plates are arranged for securement to the second hinge plates, and the third hinge plates are arranged for securement to the first hinge plates, and a plurality of hinge pins arranged for reception orthogonally through the first game plate, the second game plate, and the third game plate when in the first position and at least one of said hinge pins arranged for reception through the first hinge plates and the fourth hinge plates, and a further one of said plurality of hinge pins arranged for reception through the third hinge plates and the second hinge plates, and the at least one flexible bag member includes a bag first side wall and a bag second side wall, wherein the bag first side wall includes first side wall hook and loop fastener patch structure, and the bag second side wall includes second side wall hook and loop fastener patch structure, with the first game plate having first game plate hook and loop fastener means for adherence to the bag member, the second game plate having second hook and loop fastener means for securement to the bag member, and the third game plate including third hook and loop fastener means for securement to the bag member, and the bag member includes a cavity, the bag cavity having a flexible cavity fill member, with a central rigid bag housing positioned medially of the fill member within the bag member, and the bag housing having a central housing chamber, with a plurality of spheres mounted for movement within the central housing chamber.

2. An apparatus as set forth in claim 1 wherein each of the spheres includes a magnetic rod directed diametrically therethrough, the magnetic rod includes a first pole having a first polarity at a first end of the magnetic rod, and a second end of the magnetic rod having a second pole of a second contrasting polarity relative to the first polarity.

3. An apparatus as set forth in claim 2 including a plurality of magnetic plates mounted within the central bag housing in facing relationship relative to the spheres within the central housing chamber, wherein the magnetic plates include first magnetic plates having a first plate polarity and second magnetic plates having a second plate polarity, with the first magnetic plate and the second magnetic plates alternatively positioned within the central housing chamber fixedly mounted to the central bag housing within the central housing chamber in a facing relationship relative to the spheres.

* * * * *